US008525141B2

(12) United States Patent
Dror

(10) Patent No.: US 8,525,141 B2
(45) Date of Patent: Sep. 3, 2013

(54) COLLIMATOR ALIGNMENT SYSTEM AND METHOD

(75) Inventor: Uzi Dror, Haifa (IL)

(73) Assignee: General Electric Company, Schenectady, NY (US)

( * ) Notice: Subject to any disclaimer, the term of this patent is extended or adjusted under 35 U.S.C. 154(b) by 245 days.

(21) Appl. No.: 13/006,094

(22) Filed: Jan. 13, 2011

(65) Prior Publication Data

US 2012/0181457 A1 Jul. 19, 2012

(51) Int. Cl.
*G21K 5/04* (2006.01)

(52) U.S. Cl.
USPC ..... 250/505.1; 250/515.1; 250/517.1; 250/518.1; 250/519.1; 378/147; 378/148; 378/149; 378/150; 378/151; 378/152; 378/153

(58) Field of Classification Search
USPC ..... 378/147, 148, 149, 150, 151, 152, 378/153; 250/505.1, 515.1, 517.1, 518.1, 250/519.1
See application file for complete search history.

(56) References Cited

U.S. PATENT DOCUMENTS

| | | | | |
|---|---|---|---|---|
| 4,791,300 | A * | 12/1988 | Yin | 250/363.01 |
| 6,590,214 | B1 | 7/2003 | Karmalawy | |
| 7,580,508 | B2 | 8/2009 | Burckhardt et al. | |
| 2004/0017887 | A1 * | 1/2004 | Le et al. | 378/57 |
| 2005/0080331 | A1 * | 4/2005 | Burckhardt et al. | 600/411 |

* cited by examiner

*Primary Examiner* — Nicole Ippolito
(74) *Attorney, Agent, or Firm* — Fletcher Yoder, P.C.

(57) ABSTRACT

In one embodiment, a system for aligning collimators in an imaging system includes a transmitter coupled to a first detector and configured to transmit a beam, and a receiver coupled to a second detector and configured to receive the beam transmitted from the first detector. The alignment system also includes a cart comprising an alignment device with the cart configured to hold at least two collimators. The system includes a control system configured to align the first and second detectors with the at least two collimators using the alignment device.

18 Claims, 4 Drawing Sheets

COLLIMATOR ALIGNMENT SYSTEM AND METHOD

BACKGROUND OF THE INVENTION

The subject matter disclosed herein relates to single photon emission computed tomography (SPECT), and more particularly to a system and method for aligning collimators with detectors in medical imaging.

A wide range of imaging techniques are known and currently in use, particularly for medical diagnostic applications. One such technique, SPECT, relies on the emission of gamma rays during the radioactive decay of a radioisotope (or radionuclide), commonly administered in the form of a radiopharmaceutical agent that can be carried, and in some cases, bound to particular tissues of interest. A SPECT scanner detects the emissions via a gamma camera that typically includes a collimator, a scintillator, and a series of photomultiplier tubes. The collimator allows only emissions in a particular direction to enter into the scintillator. The scintillator converts the gamma radiation into lower energy ultraviolet photons that impact regions (pixels) of the photomultiplier tubes. These, in turn, generate image data related to the quantity of radiation impacting the individual regions. Image reconstruction techniques, such as backprojection, may then be used to construct images of internal structures of the subject based upon this image data.

While such systems have proven extremely useful at providing high quality images with good diagnostic value, further refinement is needed. For example, a system may include a gamma camera with two detectors. Each detector uses a collimator to allow only certain emissions. When collimators are attached to the detectors, the collimators need to be aligned with the detectors and each other for proper operation. Furthermore, the alignment position may change due to such things as settling of the floor, temperature changes, floor deviations, and use of collimators on different system. Manual alignment procedures may be performed by trained service personnel to enable the collimators and detectors to be aligned. However, the number of service personnel available to perform alignment procedures may be limited, and the cost for service personnel to perform the alignment procedures on a regular basis may inhibit routine alignment. Therefore, a system that automatically assists in aligning the detectors and collimators may be desirable.

BRIEF DESCRIPTION OF THE INVENTION

In one embodiment, a system for aligning collimators in an imaging system includes a transmitter coupled to a first detector and configured to transmit a beam, and a receiver coupled to a second detector and configured to receive the beam transmitted from the first detector. The alignment system also includes a cart comprising an alignment device with the cart configured to hold at least two collimators. The system includes a control system configured to align the first and second detectors with the at least two collimators using the alignment device.

In another embodiment, a method for aligning collimators in an imaging system includes transmitting a beam via a transmitter coupled to a first detector and receiving the beam via a receiver coupled to a second detector. The alignment method also includes detecting a cart between the first and the second detectors. The cart includes an alignment device and is configured to hold at least two collimators. The method includes adjusting the position of the first and second detectors to be aligned with the alignment device.

In a further embodiment, a system for aligning collimators in an imaging system includes a transmitter coupled to a first detector and configured to transmit a laser beam, and a receiver coupled to a second detector and configured to receive the laser beam transmitted from the first detector. The alignment system also includes a cart comprising two collimators and an alignment device with an opening. The system includes a motor configured to move the first and second detectors to an alignment position where the laser beam travels through the opening of the alignment device.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
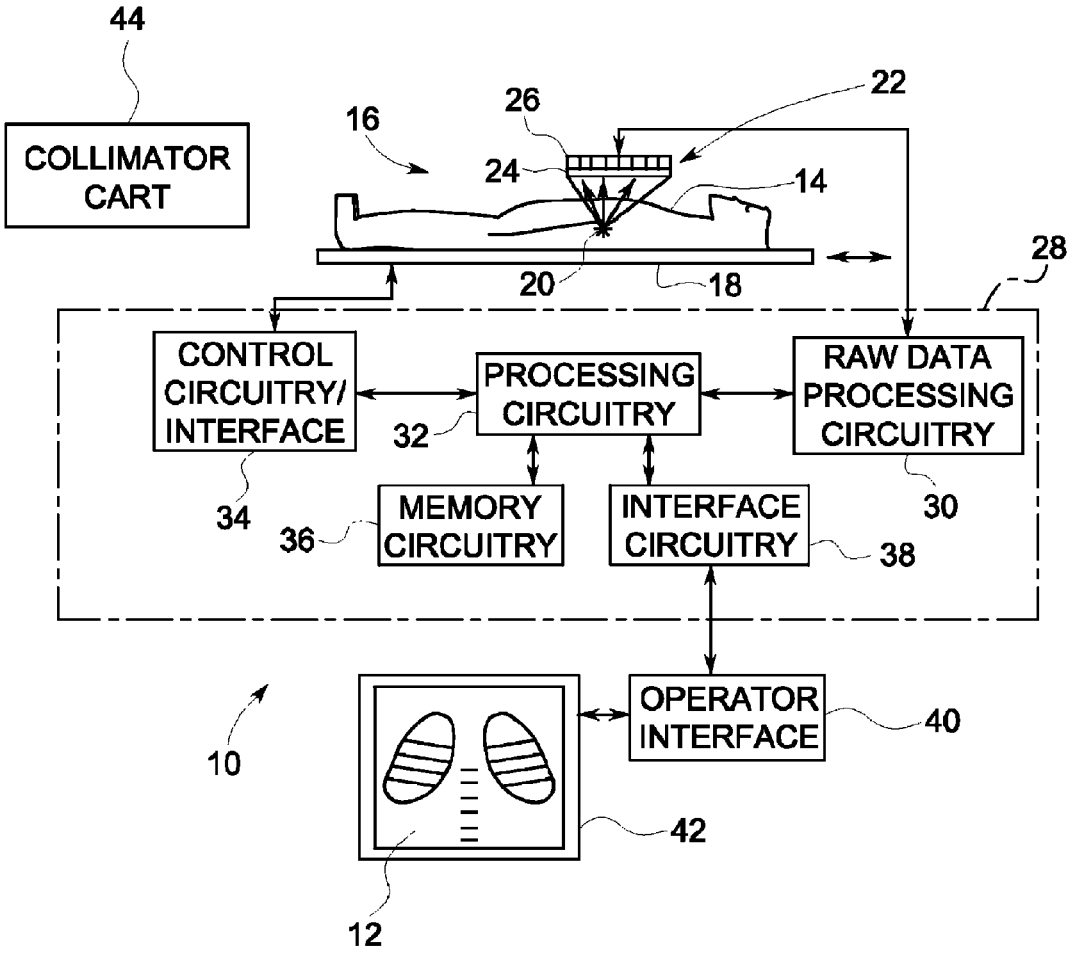
FIG. 1 is a diagrammatic representation of an exemplary SPECT imaging system incorporating aspects of the present techniques.

A diagrammatic representation of an exemplary SPECT imaging system is shown in FIG. 1. The system, designated generally by the reference numeral 10, is designed to produce useful images 12 of a subject 14. The subject is positioned in a scanner, designated by reference numeral 16 in which a patient support 18 is positioned. The support may be movable within the scanner to allow for imaging of different tissues or anatomies of interest within subject. Prior to image data collection, a radioisotope, such as a radiopharmaceutical substance (sometimes referred to as a radiotracer), is administered to the patient, and may be bound or taken up by particular tissues or organs. Typical radioisotopes include various radioactive forms of elements, although many in SPECT imaging are based upon an isotope of technetium ($^{99}$Tc) that emits gamma radiation during decay. Various additional substances may be selectively combined with such radioisotopes to target specific areas or tissues of the body.

Gamma radiation 20 emitted by the radioisotope is detected by a digital detector or gamma camera 22. Although illustrated in the figure as a planar device positioned above the patient, in practice the camera may be positioned below the patient, both above and below the patient, and may wrap at least partially around the patient. In general, the gamma camera 22 comprises one or more collimators 24 and a scintillator. The collimator 24 allows gamma radiation emitted only in certain directions (typically perpendicular to the scintillator) to impact the scintillator. The scintillator, which is typically made of a crystalline material, such as sodium iodide (NaI), converts the received gamma radiation to lower energy light energy (e.g., in an ultraviolet range). Photomultiplier tubes 26 then receive this light and generate image data corresponding to photons impacting specific discrete picture element (pixel) regions.

The gamma camera 22 is coupled to system control and processing circuitry 28. This circuitry may include a number of physical and functional components that cooperate to allow the collection and processing of image data to create the desired images. For example, the circuitry may include raw data processing circuitry 30 that initially receives the data from the gamma camera 22, and that may perform various filtering, value adjustments, and so forth. Processing circuitry 32 allows for the overall control of the imaging system, and for manipulation of image data. The processing circuitry 32 may also perform calibration functions, correction functions, and so forth on the data. The processing circuitry 32 may also perform image reconstruction functions, such as functions based on known algorithms (e.g., backprojection). Such functions may also be performed in post-processing on local or remote equipment (not shown). The processing circuitry may interact with control circuitry/interface 34 that allows for control of the scanner and its components, including the patient support, camera, and so forth. Moreover, the processing circuitry 32 will be supported by various circuits, such as memory circuitry 36 that may be used to store image data, calibration or correction values, routines performed by the processing circuitry, and so forth. Finally, the processing circuitry may interact with interface circuitry 38 designed to support an operator interface 40. The operator interface allows for imaging sequences to be commanded, scanner and system settings to be viewed and adjusted, images to be viewed, and so forth. In the illustrated embodiment, the operator interface includes a monitor 42 on which reconstructed images 12 may be viewed.

In an institutional setting, the imaging system 10 may be coupled to one of more networks to allow for the transfer of system data to and from the imaging system, as well as to permit transmission and storage of image data and processed images. For example, a local area networks, wide area networks, wireless networks, and so forth may allow for storage of image data on radiology department information systems or on hospital information systems. Such network connections further allow for transmission of image data to remote post-processing systems, physician offices, and so forth.

In addition, a collimator cart 44 may be used to transport and store collimators 24. The cart 44 may also be used to assist installation of collimators 24 onto the gamma camera 22. Furthermore, the cart 44 may contain features to aid alignment of the collimators 24 to the gamma camera 22 as discussed below in connection with the following figures.

Figure 2:
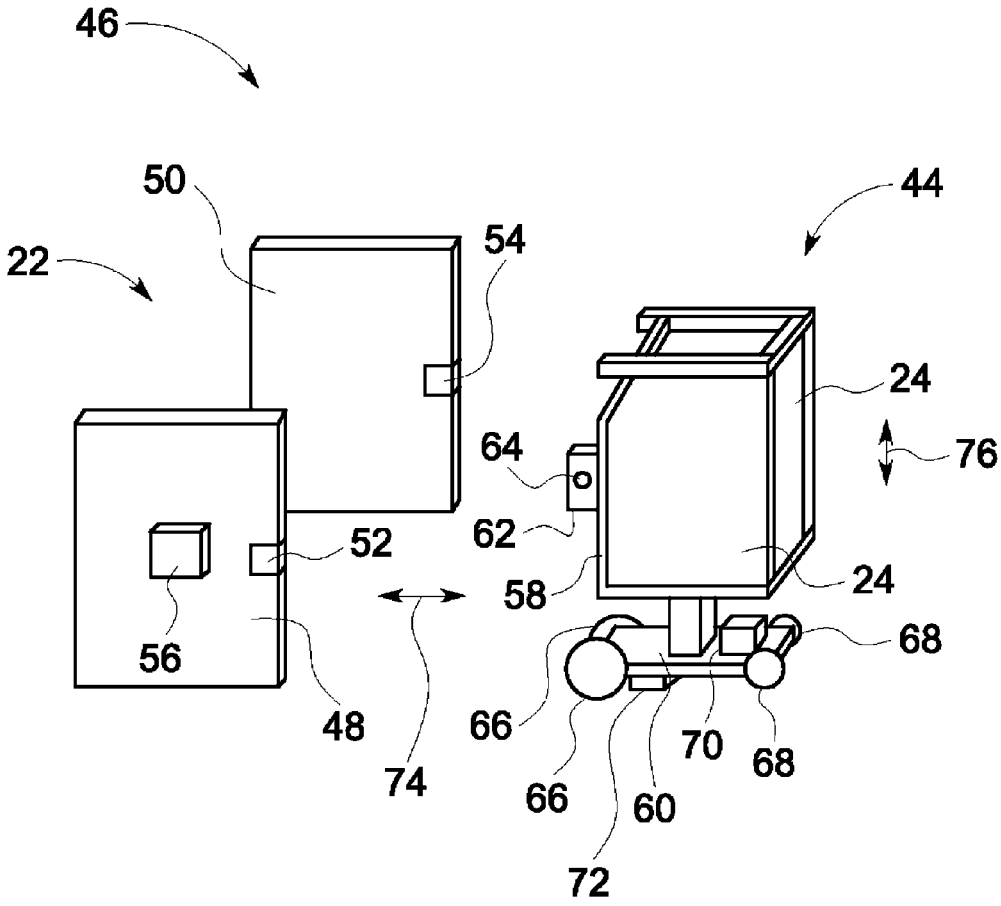
FIG. 2 is a graphical representation of an embodiment of a collimator alignment system.

FIG. 2 is a graphical representation of an embodiment of a collimator alignment system 46. A gamma camera 22 and a collimator cart 44 are illustrated. The gamma camera 22 includes a first detector 48 and a second detector 50, each for detecting gamma radiation. The first detector 48 has a transmitter 52 located adjacent to its radiation detector surface, while the second detector 50 has a receiver 54 located adjacent to its radiation detector surface. The transmitter 52 is configured to transmit a signal to the receiver 54. The signal may be any type useful to indicate that there is no physical obstruction between the transmitter 52 and the receiver 54. For example, the signal may be a laser beam transmitted between transmitter 52 and receiver 54. Therefore, when an object is placed into the path of the laser beam, the object obstructs the laser beam from traveling to the receiver 54.

The receiver 54 may send information to processing and control circuitry connected to the gamma camera 22. The information may contain data concerning whether the receiver 54 is receiving the signal transmitted from the transmitter 52. For example, when there is no obstruction between the transmitter 52 and the receiver 54, the receiver 54 may send information indicating that it is receiving the signal from the transmitter 52. Conversely, when there is an obstruction between the transmitter 52 and the receiver 54, the receiver may send information indicating that it is not receiving the signal from the transmitter 52. As illustrated, the first detector 48 may include a motor 56 or actuator to enable the detectors to move to an alignment position. Likewise, the second detector 50 may include a motor (not shown).

The collimator cart 44 includes a frame 58 arranged to hold collimators 24. The frame 58 is attached to a base 60 that provides support to the frame 58. In addition, an alignment device 62, such as a rectangular shaped plate, is attached to the frame 58. Furthermore, the alignment device 62 has a hole 64 passing through it to enable a signal, such as a laser beam, to be transmitted through the device 62. Certain embodiments may include an alignment device 62 in the shape of a triangle, circle, oval, square, or other suitable shape. Likewise, although the hole 64 is depicted as being circular, other embodiments may include a hole with any available shape to enables a beam to be transmitted through the hole. The size of the hole 64 may vary depending on the accuracy required for a particular system.

The base 60 has front wheels 66 and rear wheels 68 to enable the cart 44 to be moved between locations. The base 60 may also include control circuitry 70 and a motor 72, i.e., a control system. The control circuitry 70 may be used to control the position of the cart and may control operation of the motor 72. For example, the control circuitry 70 may cause the cart 44 to move in a horizontal direction 74 by causing the motor 72 to rotate the wheels on the cart 44. Likewise, the control circuitry 70 may cause the cart 44 to raise or lower the collimators 24 in a vertical direction 76.

As may be appreciated, to install the collimators 24 onto the detectors 48 and 50, the collimators 24 have to be properly aligned with the detectors. The alignment may be performed manually. However, manual alignment can be difficult and time consuming. Therefore, automatic alignment may be used. The cart 44 may be moved in the horizontal direction 74 toward the gamma camera 22 so that the alignment device 62 is positioned between the transmitter 52 and the receiver 54. Then the detectors 48 and 50 may be positioned using motors 56. For example, the motors 56 may move the detectors 48 and 50 in the horizontal direction 74 or in the vertical direction 76 to cause the signal sent from the transmitter 52 to travel through the hole 64 in the alignment device 62. The detectors 48 and 50 will be aligned with the collimators 24 when the signal travels through the hole 64 and is received by the receiver 54. The processing and control circuitry of the imaging system may control the motors 56 to move the detectors 48 and 50 to their proper orientation. The motors on the detectors and/or the control circuitry used to control the motors may be considered a control system. The control system may be configured with information about the alignment device 62 such as its dimensions, and the dimensions of the hole 64 to be used by the system to determine if the detectors 48 and 50 are aligned with the alignment device 62. For example, the control system may use the dimensions of the alignment device 62 to calibrate the distance to move the detectors 48 and 50 relative to a starting position.

Figure 3:
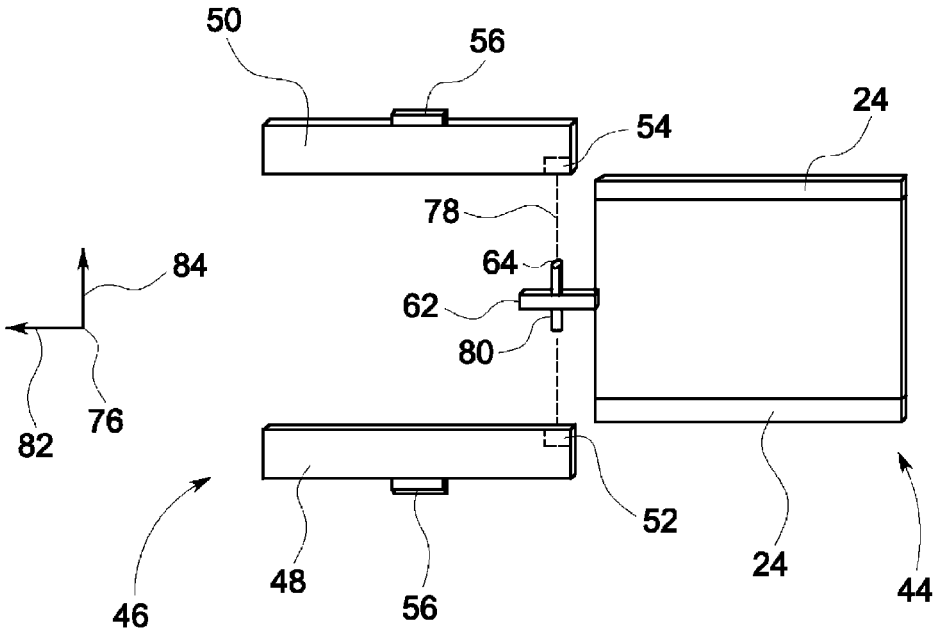
FIG. 3 is a top view graphical representation of an embodiment of a collimator alignment system.

FIG. 3 is a top view graphical representation of an embodiment of a collimator alignment system 46. The collimator cart 44 is depicted in a position aligned with the detectors 48 and 50. Collimators 24 are located on the cart 44 prior to being attached to the detectors 48 and 50. Like the prior embodiment, the first detector 48 has the transmitter 52, while the second detector has the receiver 54. Motors 56 are attached to each of the detectors 48 and 50 to control the detector movement and perform alignment of the detectors to the alignment device 62. The alignment device 62 is depicted with the hole 64 extending through the device 62. Furthermore, a beam 78 is illustrated traveling from the transmitter 52, through a tube 80 mounted in the alignment device 62, and being received by the receiver 54. As such, the detectors 48 and 50 are aligned with the collimators 24.

The alignment device 62 may include the tube 80 as illustrated, or in other embodiments may only include the hole 64 extending through the device 62. As may be appreciated, with the tube 80 extending out of the alignment device 62, an alignment angle and position may be more precisely reached. For example, the diameter and/or length of the tube 80 may prevent an unacceptable angle deviation between the detectors 48 and 50, and collimators 24.

To obtain the alignment position, the motors 56 may be controlled by imaging system control circuitry that causes the motors to move the detectors 48 and 50 generally in the vertical direction 76. As such, the motors 56 may adjust the detectors 48 and 50 up and/or down until the signal 78 is received by the receiver 54. Likewise, the motors 56 may move the detectors 48 and 50 in a direction 82 or a direction 84 to attain alignment.

Figure 4:
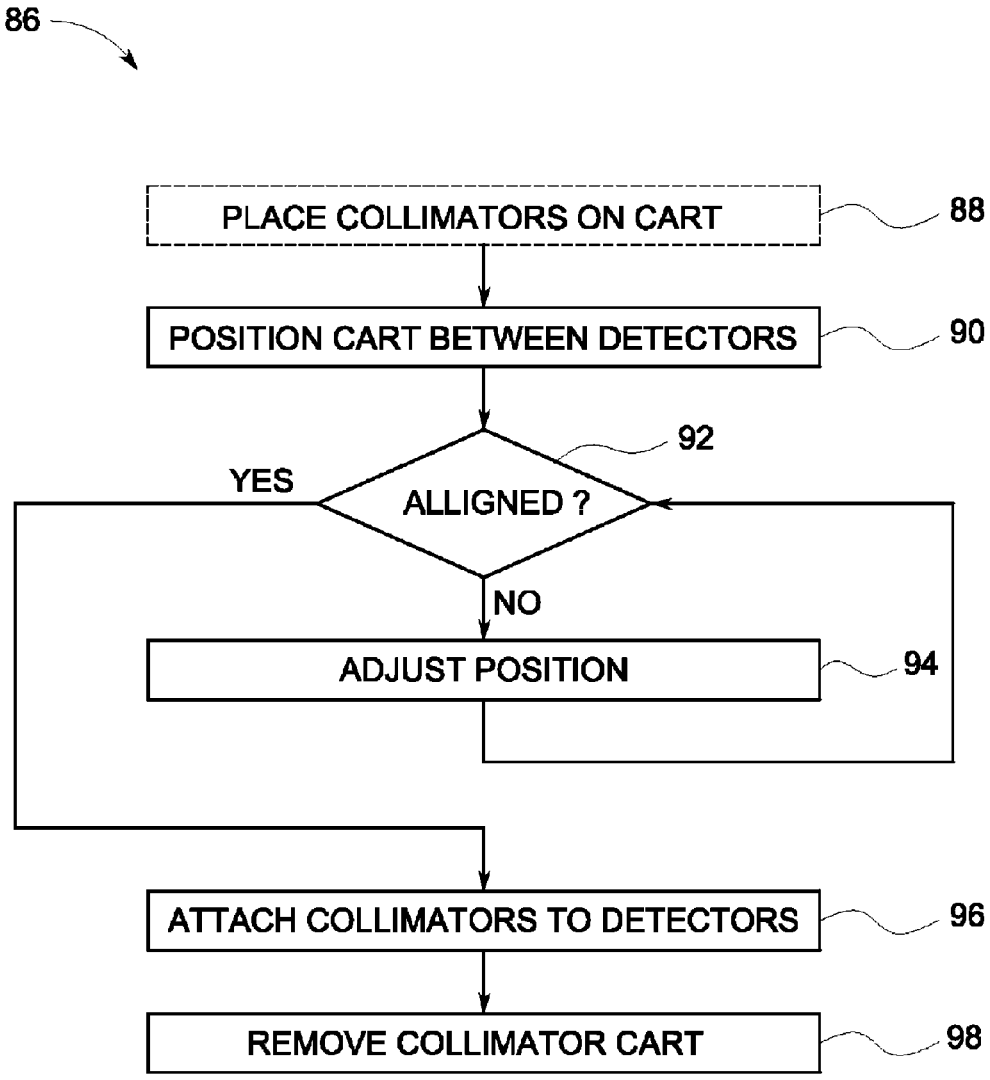
FIG. 4 is a flow chart of an embodiment of a method for aligning collimators in an imaging system.

FIG. 4 is a flow chart of an embodiment of a method for aligning collimators in an imaging system 86. It should be noted that the steps described below may be completed in any appropriate order. Likewise, some steps described are optional, while other steps may be added.

At step 88, collimators may be placed on a collimator cart to be transported to another location. Then at step 90, the collimator cart is positioned so that the alignment device is located between the detectors so that the alignment device blocks the signal sent from a transmitter to a receiver. Thus, the receiver may detect that the cart has been positioned between the transmitter and the receiver. Next at step 92, the imaging system determines whether the alignment device is properly aligned between the detectors, i.e., the detectors are aligned with the collimators. If the detectors are not aligned with the collimators, the position of the detectors is adjusted, per step 94. The position may be adjusted vertically, horizontally, or any other possible position adjustment. As may be appreciated, other embodiments may cause the collimator cart to move in place of or in conjunction with the detectors for the detectors to be aligned with the collimators.

The method then returns to step 92 to determine whether the detectors are aligned with the collimators. If the detectors and collimators are still not aligned, step 94 is repeated until the detectors and collimators are aligned. After the collimators are aligned, the collimators are attached to the detectors per step 96. Next at step 98, the collimator cart is removed from the detector area and placed in another location, such as a storage area.

It should be understood that the alignment devices and methods described herein may include other configurations, and that the descriptions provided are as examples only. As such, it is contemplated that other embodiments of alignment devices and methods may include: aligning the detectors with each other prior to positioning the alignment device between the detectors, moving only one detector to perform alignment, moving both detectors in a synchronized manner to perform alignment, moving both detectors in an unsynchronized manner to perform alignment, performing alignment by moving the collimator cart without moving the detectors, performing alignment by moving the collimator cart in conjunction with the detectors, and so forth.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system for aligning collimators in an imaging system, comprising:
   - a transmitter coupled to a first detector and configured to transmit a laser beam;
   - a receiver coupled to a second detector and configured to receive the laser beam transmitted from the first detector;
   - a cart comprising two collimators and an alignment device with an opening; and
   - a motor configured to move the first and second detectors to an alignment position where the laser beam travels through the opening of the alignment device.

2. The system of claim 1, wherein the alignment device comprises a plate with a tube positioned within the opening.

3. The system of claim 1, wherein the motor moves the first and second detectors in a generally vertical direction.

4. The system of claim 1, wherein the first and second detectors are moved to the alignment position automatically.

5. A system for aligning collimators in an imaging system, comprising:
   - a transmitter coupled to a first detector and configured to transmit a beam;
   - a receiver coupled to a second detector and configured to receive the beam transmitted from the first detector;
   - a cart comprising an alignment device, the cart configured to hold at least two collimators; and
   - a control system configured to align the first and second detectors with the at least two collimators using the alignment device;
   - wherein the first and second detectors are aligned with the cart when the beam is transmitted from the first detector, travels through an opening in the alignment device, and is received by the second detector.

6. The system of claim 5, comprising at least one actuator in communication with the control system, and wherein the first and second detectors are aligned with the at least two collimators by movement of at least one of the first and second detectors via the at least one actuator.

7. The system of claim 5, wherein the first and second detectors are aligned with the at least two collimators by alignment of the first and second detectors with one another via the alignment device.

8. The system of claim 5, wherein the first detector is configured to transmit a laser beam and the second detector is configured to receive the laser beam.

9. The system of claim 5, wherein the alignment device comprises a plate with an opening.

10. The system of claim 5, wherein the plate comprises a tube positioned within the opening.

11. The system of claim 5, wherein the control system moves the first and second detectors in a generally vertical direction.

12. The system of claim 11, wherein the control system moves the first and second detectors in a generally horizontal direction.

13. The system of claim 5, wherein the control system moves the cart.

14. A method for aligning collimators in an imaging system, comprising:

transmitting a beam via a transmitter coupled to a first detector;

receiving the beam via a receiver coupled to a second detector;

detecting a cart between the first and the second detectors, the cart comprising an alignment device and configured to hold at least two collimators; and adjusting the position of the first and second detectors to be aligned with the alignment device;

wherein the first and second detectors are aligned with the alignment device when the beam travels through an opening in the alignment device before it is received by the second detector.

15. The method of claim 14, comprising attaching a first collimator to the first detector and a second collimator to the second detector.

16. The method of claim 14, wherein the alignment device comprises a plate with an opening.

17. The method of claim 14, wherein adjusting the position of the first and second detectors comprises moving the first and second detectors in a generally vertical direction.

18. The method of claim 14, wherein adjusting the position of the first and second detectors occurs automatically.

* * * * *